United States Patent [19]

Miyake et al.

[11] Patent Number: 5,020,220

[45] Date of Patent: Jun. 4, 1991

[54] DEVICE FOR OPENING FILM-LIKE CLOSURE

[75] Inventors: Sanae Miyake; Masaaki Kasai; Sakae Yamazaki; Takato Murashita, all of Yamanashi, Japan

[73] Assignee: Terumo Kabushiki Kaisha, Tokyo, Japan

[21] Appl. No.: 469,941

[22] Filed: Jan. 25, 1990

[30] Foreign Application Priority Data

Jan. 27, 1989 [JP] Japan ..... 1-18223

[51] Int. Cl.[5] ..... B67B 7/00

[52] U.S. Cl. ..... 30/2; 222/83

[58] Field of Search ..... 30/1.5, 2, 300, 310, 30/366, 368; 81/3.48, 3.49; 222/83, 83.5, 88; 220/277

[56] References Cited

U.S. PATENT DOCUMENTS 3,581,605 6/1971 Taylor ..... 30/1.5 X
4,723,687 2/1988 Kutterer ..... 222/83

FOREIGN PATENT DOCUMENTS

A20213559 8/1986 European Pat. Off. .
249159 7/1912 Fed. Rep. of Germany .
604966 10/1948 United Kingdom .

*Primary Examiner*—Douglas D. Watts
*Attorney, Agent, or Firm*—Frishauf, Holtz, Goodman & Woodward

[57] ABSTRACT

A film-like closure opener opens a film-like closure such as a cap or lid which closes an open end of a bottomed tubular container such as a blood collecting tube. The film-like closure opener includes a cutter having a circular cutting edge for cutting off at least a substantial portion of the film-like closure along the open end of the tubular container. The opener may have a needle for piercing an elastic member on the film-like closure, so that the cut-off closure can be removed with the needle. The opener also has a gripper which is manually held and pushed to force the cutter into the tubular container while cutting off the film-like closure.

20 Claims, 7 Drawing Sheets

DEVICE FOR OPENING FILM-LIKE CLOSURE

BACKGROUND OF THE INVENTION

The present invention relates to a device for opening a film-like closure such as a cap or lid on a container, and more particularly to a film-like closure opener which can easily and quickly open a film-like cap or lid that closes the opening of a tubular container such as a blood collecting tube or the like.

Evacuated blood collecting tubes of glass or plastic are mainly used as blood sample containers in the biochemical examination of blood. Sampled blood is extracted from a blood collecting tube and examined by an automatic blood examining apparatus. Many automatic blood examining apparatus are constructed such that the blood collecting tube must be supplied thereto after the cap or lid of the blood collecting tube has been removed, thereby opening the tube. If the cap or lid is in the form of a rubber plug, a device for removing the rubber plug is used.

Recent years have seen the use of blood collecting tubes of plastic. The plastic blood collecting tubes have thin films which serve as closures such as caps or lids sealing the openings of the tubes. Such a film-like closure is kept taut over the open end of a blood collecting tube, thus closing and sealing the tube opening. The film-like closure cannot, however, be quickly peeled off manually since it is intimately bonded to a flange which defines the opening of the tube. There has not been developed any means for automatically peeling off such a film-like closure from a blood collecting tube.

SUMMARY OF THE INVENTION

It is a general object of the present invention to provide a film-like closure opener which can easily cut off a film-like closure along the edge of an opening of a tubular container that is closed by the film-like closure.

Another object of the present invention is to provide a film-like closure opener which is simple in structure, can be manufactured inexpensively, and can be handled with ease.

Still another object of the present invention is to provide a film-like closure opener which has a needle for piercing a film-like closure that closes an opening of a container and includes an elastic member, and which also has a cutter for cutting off the film-like closure along the edge of the opening, the film-like closure opener being capable of removing the film-like closure from the tubular container through elastic frictional engagement of the elastic member with the needle.

Yet another object of the present invention is to provide a film-like closure opener which has a needle for piercing a film-like closure that closes an opening of a tubular container and includes an elastic member, and which also has a cutter for cutting off the film-like closure while displacing a guide of the cutter along the tubular container.

A further object of the present invention is to provide a device for opening a film-like closure which seals an open end of a bottomed cylindrical tubular container, the device comprising a cutter having a circular cross section, the cutter including a cutting edge for cutting off at least a substantial portion of the film-like closure along the open end of the tubular container, and gripper means for displacing the cutter with respect to the tubular container.

A still further object of the present invention is to provide the device wherein the cutter is of a substantially solid cylindrical shape, and the cutter has on one end thereof a surface which is slanted with respect to the axis of the cutter, the cutting edge being disposed on a circumference of the slanted surface.

A yet still further object of the present invention is to provide the device wherein the cutting edge has an edge-free recess in the circumference of the slanted surface.

Another object of the present invention is to provide the device wherein the cutter includes a stopper on a side of the cylindrical shape thereof.

Still another object of the present invention is to provide the device wherein the cutter includes a stopper aligned with the edge-free recess.

It is also an object of the present invention to provide a device for opening a film-like closure which seals an open end of a bottomed cylindrical tubular container, the film-like closure having a central elastic member, the device comprising a cutter including a circumferential cutting edge for cutting off the film-like closure inwardly of the open end of the tubular container, and a needle mounted on the cutter, for piercing the elastic member of the film-like closure.

Another object of the present invention is to provide the device wherein the cutter is of a substantially hollow cylindrical shape, and has a hole defined therethrough axially with respect to the cylindrical shape, the needle extending through the hole.

Still another object of the present invention is to provide the device further including a stopper mounted on the needle, for limiting displacement of the needle with respect to the cutter.

Yet another object of the present invention is to provide the device further including a stopper disposed in the hole, the needle having a pointed end extending through the stopper, for aligned piercing engagement with the elastic member of the film-like closure.

Yet still another object of the present invention is to provide the device wherein the stopper is disposed in the hole, the needle having a pointed end extending through the stopper, for aligned piercing engagement with the elastic member of the film-like closure.

A further object of the present invention is to provide the device further including a gripper mounted on one end of the needle.

A still further object of the present invention is to provide the device wherein the stopper comprises an elastic stopper slidable in the hole.

A yet further object of the present invention is to provide the device wherein the stopper comprises an elastic stopper slidable in the hole.

A yet still further object of the present invention is to provide the device further including a guide surrounding the cutter, for guiding the cutter along and around the tubular container.

Still another object of the present invention is to provide the device wherein the guide has a tapered end extending around the cutter.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
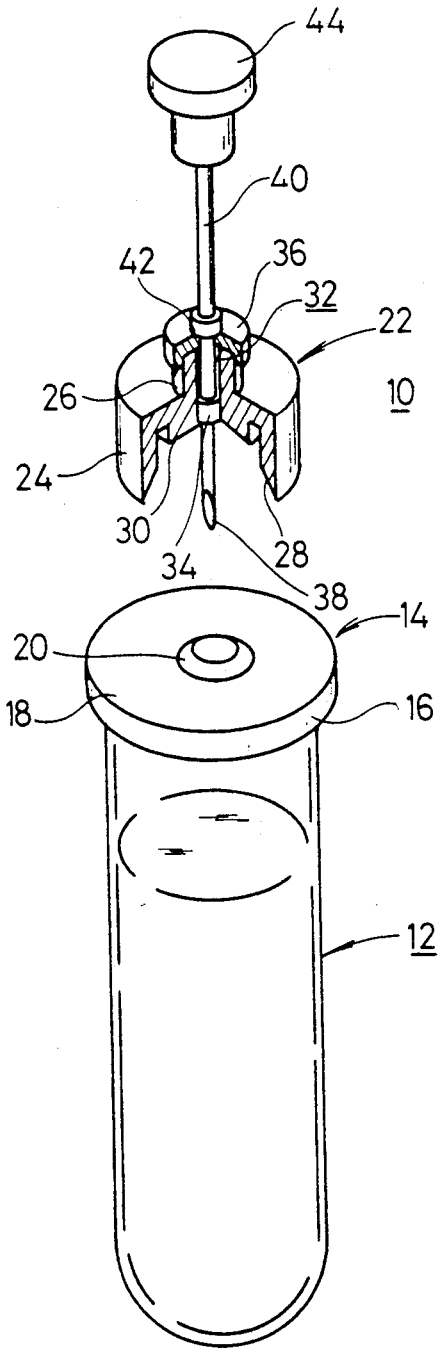
FIG. 1 is a perspective view, partly cut away, of a tubular container and a film-like closure opener according to a first embodiment of the present invention.

Like or corresponding parts are denoted by like or corresponding reference numerals throughout views.

FIG. 1 shows a film-like closure opener 10 according to a first embodiment of the present invention, and a tubular container 12 with its open end closed and sealed by a film-like closure 14 such as a cap or lid which is to be opened by the opener 10. The tubular container 12 comprises a transparent tube made of plastic, and herein serves as a blood collecting tube to store a blood sample therein.

Figure 2C:
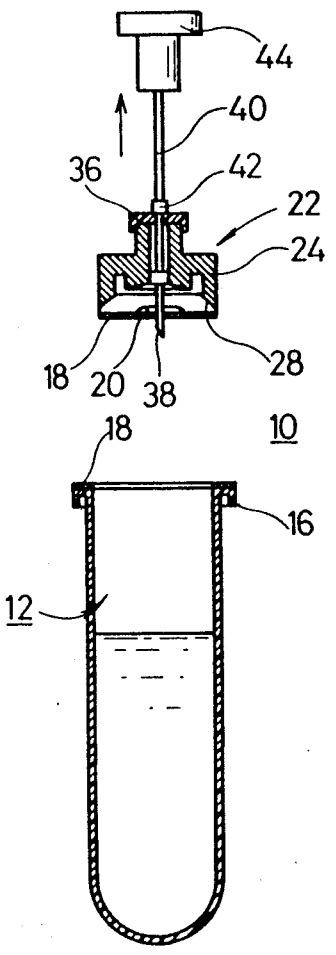
FIGS. 2(*a*), 2(*b*), and 2(*c*) are cross-sectional views showing the manner in which a film-like closure on the tubular container is opened by the film-like closure opener shown in FIG. 1.
Figure 2B:
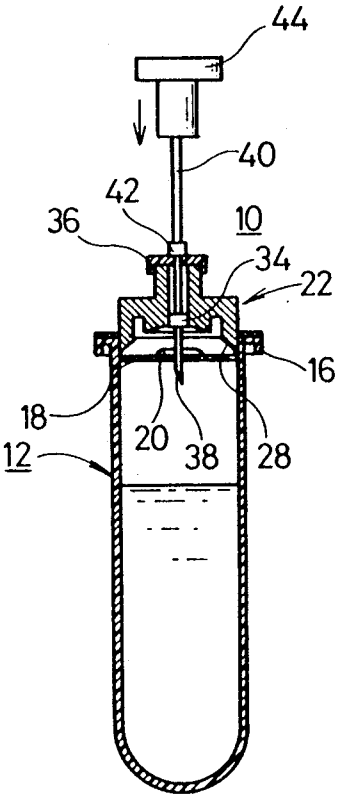
Figure 2A:
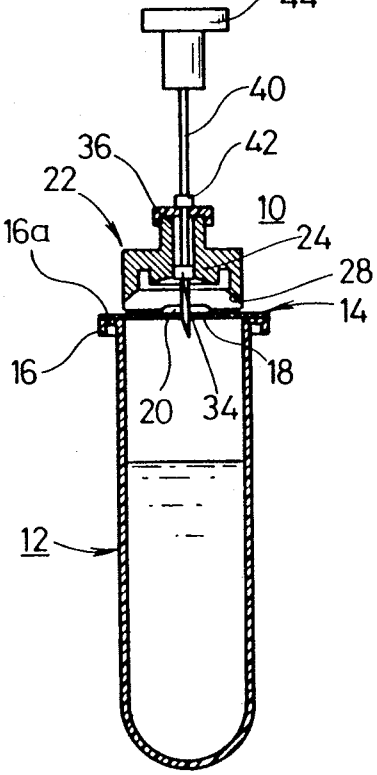

The tubular container 12 has a flange 16 extending around and projecting radially outwardly from the open end thereof. The flange 16 has a relatively flat peripheral wall 16*a* on its axial end, as shown in FIG. 2(*a*).

The film-like closure 14 is sealingly bonded in a liquidtight manner to the peripheral wall 16*a* by an adhesive, for example. The film-like closure 14 comprises a disc-shaped thin film 18 having a thickness in the range of microns, and an elastic member 20 disposed substantially centrally on the film 18. Typically, the film 18 is made of aluminum with polyethylene telephthalate thereon, and the elastic member 20 is made of natural rubber, synthetic rubber, or the like.

The film-like closure opener 10 includes a cylindrical cutter 22 made of metal or ceramic. The cylindrical cutter 22 is of a double-stepped shape including a larger-diameter portion 24 and a smaller-diameter portion 26. The larger-diameter portion 24 has a circumferential cutting edge 28 on its free end, the cutting edge 28 being of substantially the same diameter as that of the opening of the tubular container 12. The cutting edge 28 comprises a sharpened distal edge.

The smaller-diameter portion 26 has a cylindrical boss 30 concentrically disposed radially inwardly therein. The cutter 22 has a through hole 32 defined axially centrally through the boss 30 and the smaller-diameter portion 26. A first ring-shaped stopper 34, which is made of natural rubber, synthetic rubber, or the like and capable of exerting frictional forces, is slidably fitted in the through hole 32.

The smaller-diameter portion 26 has an externally threaded upper end (as shown in FIG. 1) over which there is threaded a cap nut 36 that has a through hole defined axially centrally therein. A needle 40 extends through the through hole in the cap nut 36 and also the through hole 32. A second ring-shaped stopper 42 of metal is fitted over and fixed to the needle 40 at a certain position thereon. The needle 40 has a pointed end 38. A gripper 44, which can be manually held by a doctor or a nurse, is fitted over and fixed to the other end of the needle 40.

The film-like closure opener 10 is assembled as follows: The first stopper 34 is first inserted into the through hole 32 in the boss 30, and then the needle 40 with the second stopper 42 thereon is displaced downwardly through the hole in the cap nut 36 and the through hole 32. When the second stopper 42 abuts against the cap nut 36, any further downward displacement of the needle 40 is prohibited.

The film-like closure opener 10 thus constructed operates as follows:

The cutting edge 28 of the larger-diameter portion 24 of the cutter 22 is positioned with respect to the flange 16 of the tubular container 12, such that the pointed end 38 of the needle 40 is held against the center of the elastic member 20. Then, the needle 40 is pushed downwardly by the grip 44, forcing the pointed end 38 through the elastic member 20 and then the film-like closure 14 into the tubular container 12, as shown in FIG. 2(*a*). Continued downward movement of the needle 40 causes the cutting edge 28 to enter inwardly of the flange 16, while cutting off the film-like closure 14 along the flange 16, as shown in FIG. 2(*b*).

After the opener 10 has thus been lowered into the tubular container 12, its downward displacement is stopped, and then the opener 10 is pulled upwardly as shown in FIG. 2(*c*). At this time, the elastic member 20 is held in elastic frictional engagement with the needle 40, and is also bonded to the film-like closure 14 by an adhesive or the like, as described above. Therefore, the film-like closure 14 and the elastic member 20 are removed in unison from the tubular container 12 by the needle 40 as it is pulled upwardly. The first stopper 34 slides in the through hole 32 while the needle 40 is being displaced.

Figure 3:
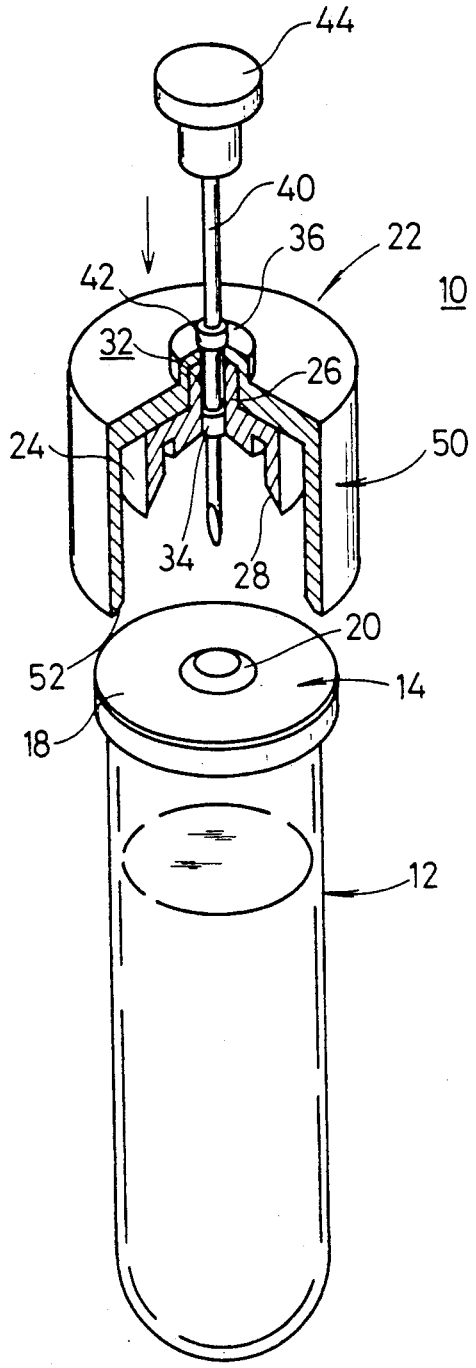
FIG. 3 is a perspective view, partly cut away, of a tubular container and a film-like closure opener according to a second embodiment of the present invention.
Figure 4C:
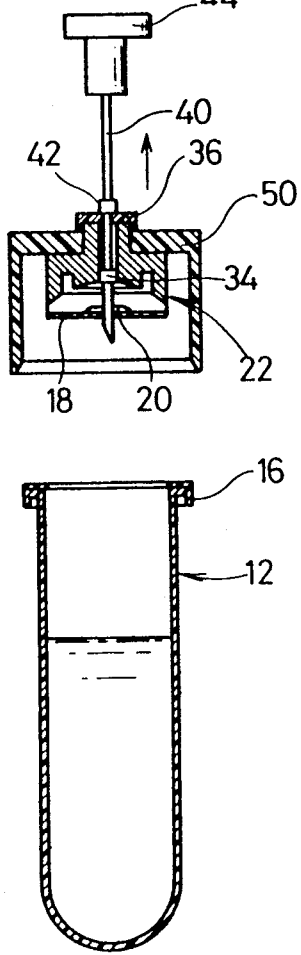
FIGS. 4(*a*), 4(*b*), and 4(*c*) are cross-sectional views showing the manner in which a film-like closure on the tubular container is opened by the film-like closure opener shown in FIG. 3.
Figure 4B:
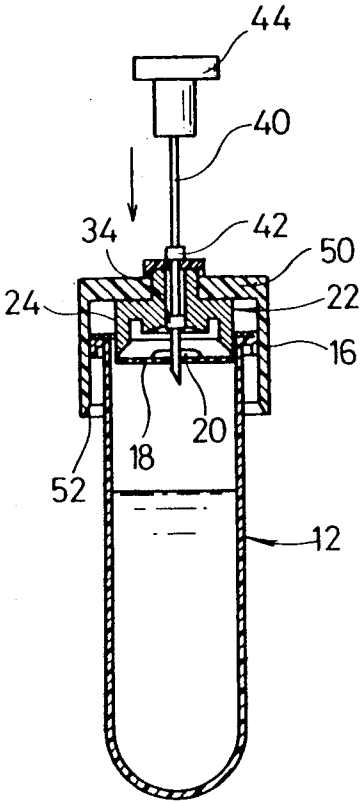
Figure 4A:
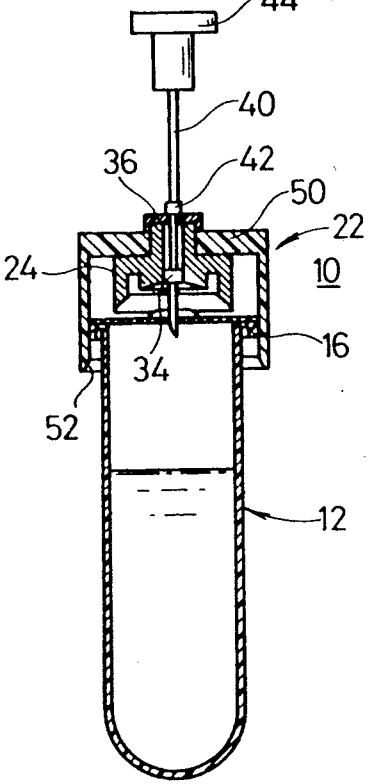

FIGS. 3 and 4(*a*) through 4(*c*) illustrate a film-like closure opener 10 according to a second embodiment of the present invention.

As shown in FIG. 3, the film-like closure opener 10 of the second embodiment differs from that of the first embodiment in that it additionally includes a surrounding hollow cylindrical guide 50 which extends around the cutter 22 and which will be fitted over the flange 16 of the tubular container 12. The guide 50 has an end wall fitted over the smaller-diameter portion 26 and held against the larger-diameter portion 24. The guide 50 has a tapered lower end 52 on a relatively thin cylindrical wall, so that the guide 50 can be fitted smoothly over the tubular container 12.

To cut off the film-like closure 14 with the opener 10 of the second embodiment, the guide 50 is first fitted over the flange 16 of the tubular container 12 while being guided by the tapered end 52, as shown in FIG. 4(*a*). Then, the gripper 44 is lowered as indicated by the arrow in FIG. 4(*b*) to cause the pointed end of the needle 40 to pierce the elastic member 20. The downward displacement of the needle 40 enables the cutting edge 28 to cut off the film-like closure 14 in a circular shape. Thereafter, the gripper 44 is pulled upwardly as indicated by the arrow in FIG. 4(*c*). At this time, the elastic member 20 and hence the film-like closure 14 are removed from the tubular container 12 in unison with the needle 40 due to elastic frictional engagement between the elastic member 20 and the needle 40. In the second embodiment, the guide 50 allows the needle 40 to pierce the elastic member 20 more easily and accurately.

Figure 5:
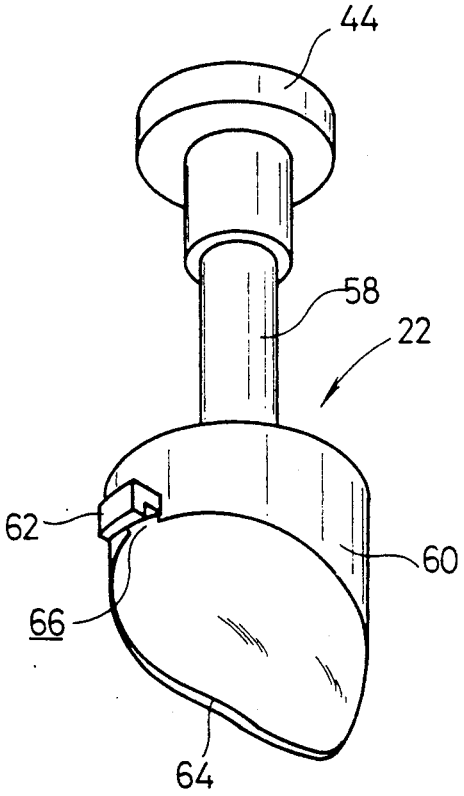
FIG. 5 is a perspective view of a film-like closure opener according to a third embodiment of the present invention.
Figure 6:
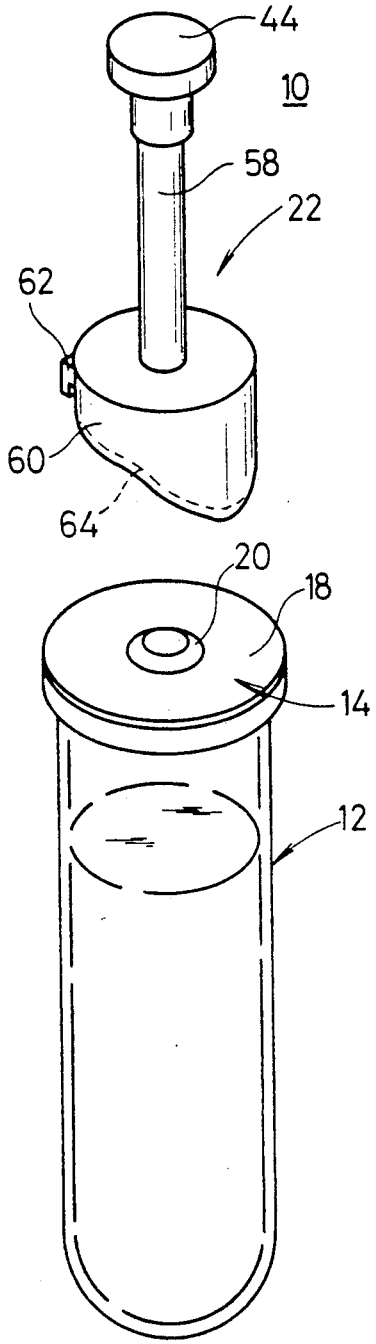
FIG. 6 is a perspective view of the film-like closure opener shown in FIG. 6, which is positioned in relation to a tubular container to be opened thereby.
Figure 7C:
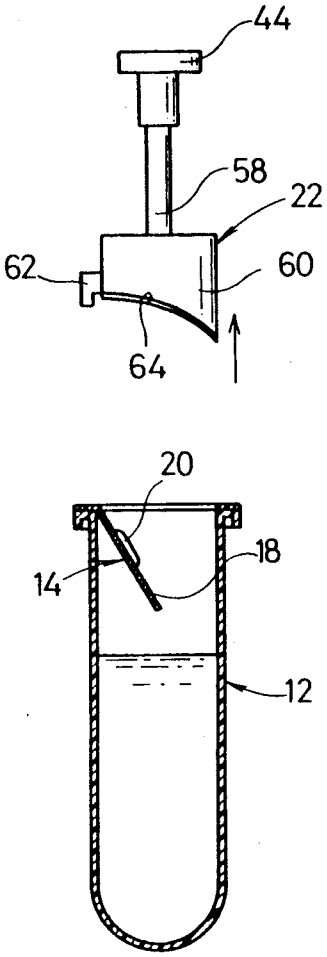
FIGS. 7(*a*), 7(*b*), and 7(*c*) are cross-sectional views showing the manner in which a film-like closure on the tubular container is opened by the film-like closure opener shown in FIGS. 5 and 6.
Figure 7B:
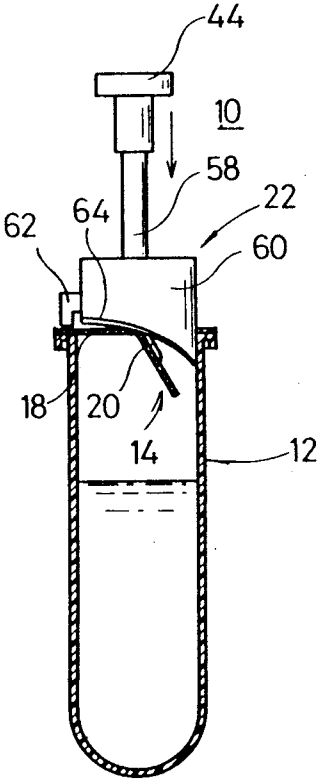
Figure 7A:
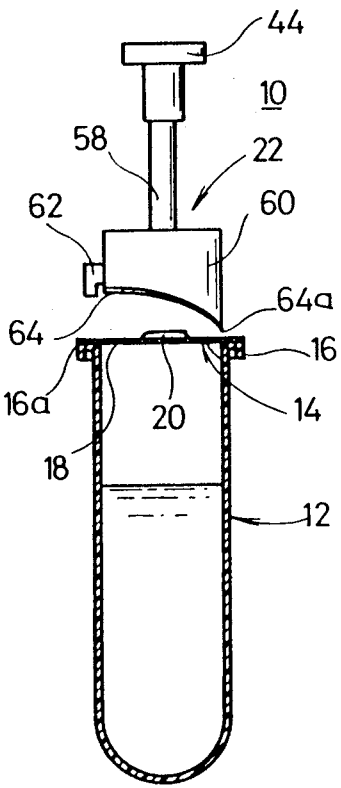

FIGS. 5, 6, and 7(*a*) through 7(*c*) show a film-like closure opener 10 in accordance with a third embodiment of the present invention. The opener 10 of the third embodiment does not have a needle as is the case with the first and second embodiments.

As shown in FIG. 5, a cutter 22 comprises a solid cylindrical body 60 with a rod 58 extending upwardly from the upper flat surface of the cylindrical body 60. The gripper 44 is mounted on the upper end of the rod 58. A stopper 62 which is bent axially is attached to one circumferential side of the cylindrical body 60. The cylindrical body 60 has a lower surface slanted at an angle to the axis thereof, and a cutting edge 64 on the outer circumference of the lower surface. The cutting edge 64 is however interrupted over a length corresponding to and axially aligned with the stopper 62. Stated otherwise, the cutting edge 64 has an edge-free recess 66 in axial alignment with the stopper 62.

In operation, the cutting edge 64 of the cylindrical body 60 of the cutter 22, especially a tip end 64*a* thereof, is held against the film-like closure 14, as shown in FIG. 7(*a*). When the gripper 44 is lowered, the film-like closure 14 is cut off by the circumferential cutting edge 64.

Since the edge-free recess 66, which is axially aligned with the stopper 62, is present in the cutting edge 64, the film-like closure 14 remains partly uncut, i.e., attached to the flange 16 of the tubular container 12. When the stopper 62 engages the peripheral wall 16*a* of the flange 16, the opener 10 is prevented from being lowered further into the tubular container 12. While the film-like closure 14 is being cut off, as shown in FIG. 7(*b*), the cut-off portion thereof depends from the elastic member 20 into the tubular container 12. Finally, when the film-like closure 14 is fully severed by the cutting edge 64, it is obliquely displaced into the tubular container 12, with one end remaining attached to the flange 16, as shown in FIG. 7(*c*). Since the film-like closure 14 remains attached at one end to the flange 16, it is prevented from falling into contact with a fluid such as blood, for example, which is stored in the tubular container 12.

With the present invention, as described above, the film-like closure which seals a fluid such as blood in the tubular container can easily and reliably be cut off thereby to open the tubular container, without any knife or other separate cutting tools being used. In the first and second embodiments of the present invention, the film-like closure which has been cut off can be removed by the opener itself. In the third embodiment, the tubular container can be opened while the film-like closure which has been cut off remains attached to the tubular container. As a result, the fluid stored in the tubular container can be extracted therefrom through the opening thereof which has thus been defined.

Inasmuch as the film-like closure opener is simple in structure, it can easily be manufactured inexpensively, and can be handled with ease.

The film-like opener of the invention is highly economical as it can be used repeatedly. If the film-like opener is mounted on a robot hand of a robot and the robot is programmed to operate the opener according to a certain pattern in repeated cycles, it can open a plurality of arrayed tubular containers within a short period of time.

Although certain preferred embodiments have been shown and described, it should be understood that many changes and modifications may be made therein without departing from the scope of the appended claims.

We claim:

1. A device for opening a film-like closure which seals the open end of a bottomed cylindrical tubular container, said device comprising:

a cutter comprising a substantially solid cylindrical body having a substantially circular cross-section and a longitudinal axis, said cylindrical body having one end thereof defining a surface which is slanted with respect to said axis of said cutter, said cutter including a cutting edge disposed on a circumference of said slanted surface for cutting off at least a substantial portion of the film-like closure along said open end of said tubular container; and gripper means for displacing said cutter with respect to said tubular container;

said circumference with said cutting edge thereon having a notch formed therein so as to prevent cutting of said film-like closure at a position corresponding to the notch; and a stopper disposed on said substantially solid cylindrical body adjacent to said cutting edge for limiting entry of said cutter into said tubular container to a predetermined distance.

2. A device according to claim 1, wherein said cutter includes a stopper aligned with said notch.

3. A device for opening a film-like closure which seals an open end of a bottomed cylindrical tubular container, said film-like closure having an elastic member mounted in the center thereof, said device comprising:

a substantially hollow cylindrical cutter having a longitudinal axis and an aperture therethrough which is aligned with said axis of said cylindrical cutter;

a cutting edge disposed on the circumference of said hollow cylindrical cutter for cutting off the film-like closure inwardly of said open end of said tubular container; and a needle mounted on said cutter so as to extend through said aperture for piercing said elastic member.

4. A device according to claim 3, wherein said needle is movably mounted in said aperture; and further comprising a stopper mounted on said needle, for limiting displacement of said needle with respect to said cutter.

5. A device according to claim 3, further including a stopper disposed in said aperture, said needle having a pointed end extending through said stopper, for aligned piercing engagement with the elastic member of the film-like closure.

6. A device according to claim 4, wherein said stopper is disposed in said aperture, said needle having a pointed end extending through said stopper, for aligned piercing engagement with the elastic member of the film-like closure.

7. A device according to claim 3, further including a gripper mounted on one end of said needle.

8. A device according to claim 5, wherein said stopper comprises an elastic stopper slidable in said aperture.

9. A device according to claim 6, wherein said stopper comprises an elastic stopper slidable in said aperture.

10. A device according to claim 3, further including a guide means surrounding said cutter, for guiding said cutter along and around said tubular container.

11. A device according to claim 10, wherein said guide means has a tapered end extending around said cutter.

12. A device according to claim 4, further including guide means surrounding said cutter, for guiding said cutter along and around said tubular container.

13. A device according to claim 12, wherein said guide means has a tapered end extending around said cutter.

14. A device according to claim 5, further including guide means surrounding said cutter, for guiding said cutter along and around said tubular container.

15. A device according to claim 14, wherein said guide means has a tapered end extending around said cutter.

16. A device according to claim 6, further including guide means surrounding said cutter, for guiding said cutter along and around said tubular container.

17. A device according to claim 16, wherein said guide means has a tapered end extending around said cutter.

18. A device for opening a film-like closure for a tubular cylindrical container having first and second end portions, said second end portion being closed, and said first end portion being sealed by said film-like closure mounted thereon, said device comprising:

cutter means having a substantially solid cylindrical body with a substantially circular cross-section;

said cylindrical body having a main axis and first and second end surfaces;

said first end surface of said cylindrical body being slanted with respect to said main axis of said cylindrical body;

a cutting edge disposed continuously around a major portion of the outer periphery of said slanted surface to pierce and then cut off a substantial portion of said film-like closure, a remaining minor portion of said periphery of said slanted surface being without said cutting edge, for thereby preventing complete severance of said film-like closure from said container; and gripper means disposed on said second end surface of said cylindrical body for displacing said cutting means relative to said film-like closure.

19. A device according to claim 18, wherein said outer periphery of said slanted surface is formed with a notch in said outer minor portion of said periphery, said notch preventing the film-like closure from being completely severed by said cutting edge.

20. A device according to claim 18, further comprising stopper means mounted on the periphery of said cylindrical body adjacent said minor portion of said periphery of said slanted surface, for limiting entry of said device into said tubular cylindrical container to a predetermined distance.

* * * * *